US007846869B2

(12) United States Patent
LaCour

(10) Patent No.: US 7,846,869 B2
(45) Date of Patent: Dec. 7, 2010

(54) PROCESS FOR PRE-TREATING A DESULFURIZATION SORBENT

(75) Inventor: Mark J. LaCour, Katy, TX (US)

(73) Assignee: China Petroleum & Chemical Corporation, Beijing (CN)

( * ) Notice: Subject to any disclaimer, the term of this patent is extended or adjusted under 35 U.S.C. 154(b) by 408 days.

(21) Appl. No.: 12/108,176

(22) Filed: Apr. 23, 2008

(65) Prior Publication Data

US 2009/0266744 A1 Oct. 29, 2009

(51) Int. Cl.
*C10G 45/08* (2006.01)

(52) U.S. Cl. ..... 502/439; 502/20; 502/216; 502/400

(58) Field of Classification Search ..... 208/213, 208/216 R, 217; 502/20, 22–55, 400
See application file for complete search history.

(56) References Cited

U.S. PATENT DOCUMENTS

| | | | |
|---|---|---|---|
| 4,111,796 | A | 9/1978 | Yanik et al. |
| 4,287,050 | A | 9/1981 | Eastman et al. |
| 4,324,647 | A | 4/1982 | Gardner |
| 4,333,855 | A | 6/1982 | Gardner et al. |
| 4,371,485 | A | 2/1983 | Mathes et al. |
| 4,372,842 | A | 2/1983 | Gardner |
| 4,376,698 | A | 3/1983 | Gardner et al. |
| 4,376,699 | A | 3/1983 | Gardner |
| 4,389,304 | A | 6/1983 | Eastman et al. |
| 4,389,305 | A | 6/1983 | Gardner et al. |
| 4,394,301 | A | 7/1983 | Gardner |
| 4,557,823 | A | 12/1985 | Kukes et al. |
| 4,560,468 | A | 12/1985 | Kukes et al. |
| 4,578,179 | A | 3/1986 | Kukes et al. |
| 4,578,180 | A | 3/1986 | Kukes et al. |
| 4,582,594 | A | 4/1986 | Kukes et al. |
| 4,600,504 | A | 7/1986 | Kukes et al. |
| 5,516,961 | A | 5/1996 | Miller et al. |
| 6,063,723 | A | 5/2000 | Miller |
| 6,291,391 | B1 | 9/2001 | MacArthur |
| 2002/0002315 | A1 | 1/2002 | Kelly et al. |
| 2005/0194320 | A1 | 9/2005 | Kennard et al. |

OTHER PUBLICATIONS

An Overview of Catalyst Sulfiding, www.gaylordchemical.com—Bulletin # 205B, Jan. 2006, pp. 1-8, Gaylord Chemical Corporation, Slidell, LA, USA.

*Primary Examiner*—Robert J Jill, Jr.
*Assistant Examiner*—Brian McCaig
(74) *Attorney, Agent, or Firm*—Hovey Williams LLP

(57) ABSTRACT

A process for presulfiding a plurality of sorbent particles prior to using at least a portion of the particles to at least partially desulfurize a hydrocarbon feed stream. Typically, presulfiding can be carried out in a presulfiding zone under presulfiding conditions. In one embodiment, the process can be carried out in a desulfurization system comprising a fluidized bed reactor and fluidized bed regenerator and can be completed in less than about 36 hours.

46 Claims, 2 Drawing Sheets

PROCESS FOR PRE-TREATING A DESULFURIZATION SORBENT

BACKGROUND

1. Field of the Invention

This invention relates to processes for pre-treating sorbent compositions employed in desulfurization systems. In another aspect, the invention concerns a process for presulfiding a desulfurization sorbent in situ prior to using the presulfided sorbent composition to desulfurize a hydrocarbon-containing fluid stream.

2. Description of the Related Art

The increased global demand for cleaner burning fuels has driven the worldwide effort to reduce the sulfur levels in many hydrocarbon-based fuels, such as gasoline and diesel. Lower-sulfur fuel blends contribute to improved air quality by minimizing the adverse impact on emissions-regulating automotive components, such as, for example, highly sulfur-sensitive catalytic converters. Automobiles operating with inefficient or poisoned catalytic converters emit exhaust containing high levels of non-combusted, heavier-than-methane hydrocarbons, nitrogen oxides (i.e., $NO_x$), sulfur oxides (i.e., $SO_x$), and carbon monoxide. Catalyzed by sunlight, these components react to form ground-level ozone, more commonly referred to as "smog."

In recent years, the public discussion regarding the reduction of sulfur levels in fuel blends has not focused on whether or not such a reduction should occur, but, rather, has centered on the required level of reduction, as well as the time frame for the implementation of corresponding regulations. Within the last several years, several countries, including China, the United States, Japan, India, Brazil, and the European Union have begun issuing mandates requiring progressively lower sulfur levels (e.g., some less than 10 ppmw) in automotive fuels, including both gasoline and diesel.

These stricter regulations have lead oil refiners and other fuel producers/blenders to alter their current fuel production schemes to include processes for desulfurizing the hydrocarbon-containing streams used as blendstocks for producing different types of consumer fuels, including, for example, typical automotive gasolines and diesels, heavy equipment diesel fuels, racing gasolines, aviation gasolines, boat gasolines, and the like. Examples of hydrocarbon streams used as blendstocks to produce these fuels include, but are not limited to, thermally and/or catalytically processed gasolines such as, for example, thermally cracked gasoline, visbreaker gasoline, coker gasoline and catalytically cracked gasoline (hereinafter collectively referred to as "cracked gasoline").

At the same time, simultaneous increases in demand for refined products, such as gasoline, diesel, and related commodity fuels coupled with intensifying supply-side pressures have lead to record fuel prices. To maximize profits, especially in light of the additional capital investment and operating expense associated with the newly-added desulfurization process step, have caused refiners to strive to increase the time gasoline-producing units are operational (i.e., unit uptime or on-stream time). In order to properly maintain these process units, however, operators must take the units "offline" (i.e., suspend production to repair and clean the unit) to ensure efficient and safe unit operation. It is desirable to minimize these downtimes and to return to maximum production mode as quickly as possible in order to maximize profits.

SUMMARY

In one embodiment of the present invention, there is provided a process for removing sulfur from a hydrocarbon feed stream in a desulfurization system, wherein the desulfurization system comprises a reactor and a regenerator, the process comprising: (a) contacting a plurality of sorbent particles with a presulfiding agent under presulfiding conditions in the reactor to thereby provide a plurality of at least partly sulfided sorbent particles; (b) introducing at least a portion of the at least partly sulfided sorbent particles into the regenerator; (c) withdrawing at least a portion of the at least partly sulfided sorbent particles from the regenerator; (d) returning at least a portion of the at least partly sulfided sorbent particles withdrawn from the regenerator to the reactor; (e) repeating steps (a) through (d) until the at least partly sulfided sorbent particles introduced into the regenerator have an average sulfur loading that is at least 15 percent greater than the initial average sulfur loading of the sorbent particles prior to the contacting of step (a); and (f) subsequent to step (e), contacting the at least partly sulfided sorbent particles with the hydrocarbon feed stream under desulfurization conditions in the reactor to thereby provide a sulfur-depleted effluent stream and a sulfur-laden sorbent, wherein the average sulfur loading of the at least partly sulfided sorbent particles introduced into the regenerator in step (b) is within 5 percent of the average sulfur loading of the at least partly sulfided sorbent particles withdrawn from the regenerator in step (c).

In another embodiment of the present invention, there is provided a process for desulfurizing a sulfur-containing hydrocarbon feed stream, the process comprising: (a) introducing a plurality of sorbent particles into a reaction zone, wherein the sorbent particles have an average sulfur loading of less than 1.75 weight percent; (b) contacting at least a portion of the sorbent particles with a presulfiding agent in the reaction zone under presulfiding conditions to thereby provide a plurality of at least partly sulfided sorbent particles; (c) repeating step (b) out until the at least partly sulfided sorbent particles have an average sulfur loading greater than 2.0 weight percent; (d) subsequent to step (c), introducing the hydrocarbon feed stream into the reaction zone; (e) contacting at least a portion of the at least partly sulfided sorbent particles with at least a portion of the hydrocarbon feed stream in the reaction zone under desulfurization conditions to thereby provide a sulfur-laden sorbent and a sulfur-depleted effluent stream; (f) regenerating at least a portion of the sulfur-laden sorbent in a regeneration zone under regeneration conditions to thereby provide a regenerated sorbent composition; and (g) introducing at least a portion of the regenerated sorbent composition back into the reaction zone.

BRIEF DESCRIPTION OF THE FIGURES

Certain embodiments of the present invention are described in detail below with reference to the enclosed figures, in which like reference numerals are used to indicate like parts in the various views, wherein.

DETAILED DESCRIPTION

Figure 1:
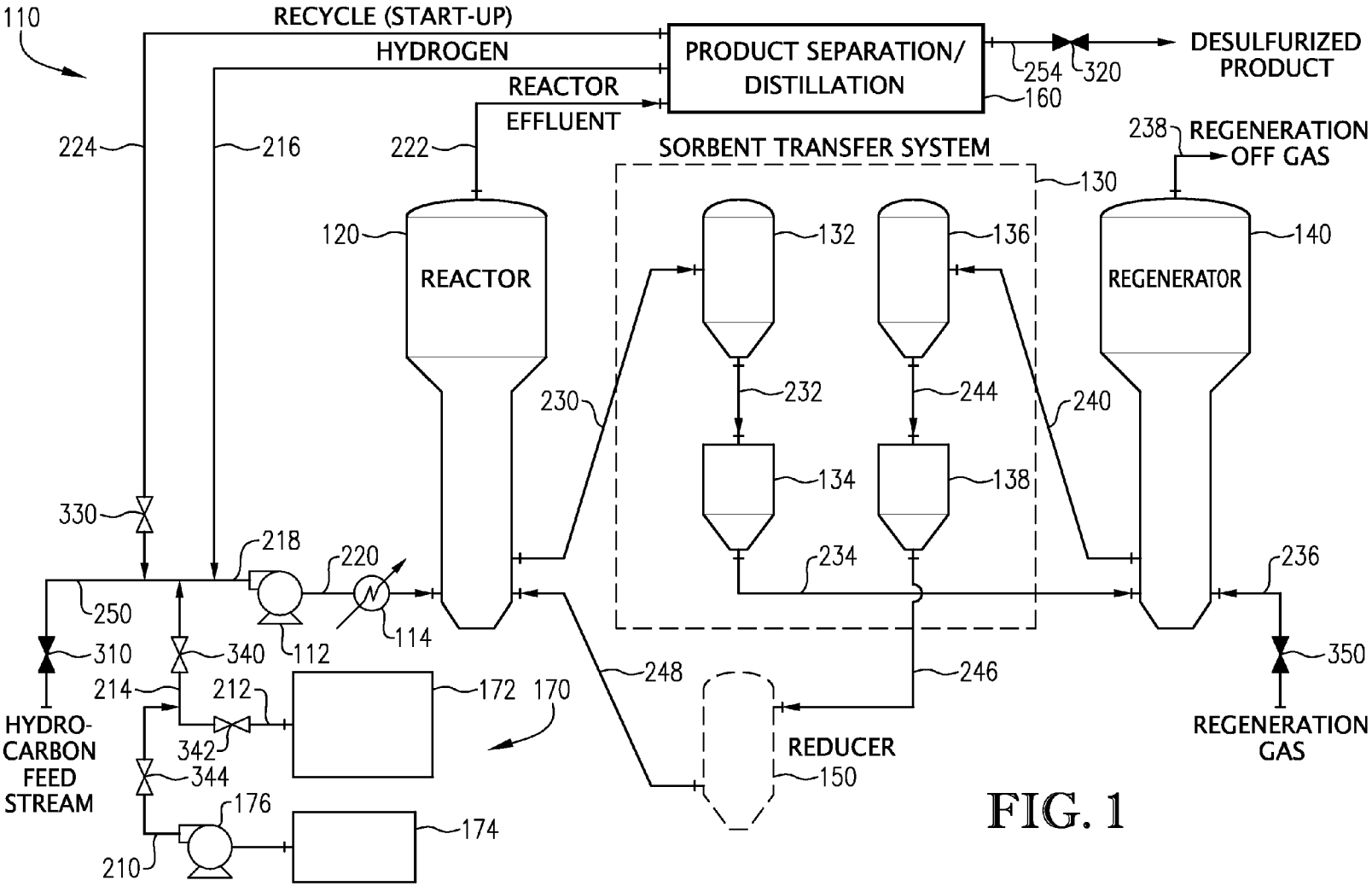
FIG. 1 is a schematic diagram of a desulfurization system configured according to one embodiment of the present invention that employs a plurality of desulfurization sorbent particles.

According to one embodiment, the present invention can be implemented in any desulfurization process or system that utilizes a plurality of solid sorbent particles to remove at least a portion of one or more sulfur-containing compounds from a hydrocarbon fluid stream. In general, the desulfurization process can comprise the steps of (1) contacting a sulfur-containing hydrocarbon fluid stream with a plurality of solid sorbent particles in a reaction zone under reaction conditions to thereby provide an at least partially desulfurized hydrocarbon stream and a sulfur-laden sorbent; (2) regenerating at least a portion of the sulfur-laden sorbent particles in a regeneration zone under regeneration conditions to thereby provide a regenerated sorbent; and, optionally, (3) reactivating (i.e., reducing) at least a portion of the regenerated sorbent particles in a reduction zone under reduction conditions to thereby provide a reduced sorbent composition that can subsequently be reemployed in the reaction zone, as previously described.

In one embodiment, it may be advantageous to chemically and/or physically condition at least a portion of the sorbent particles prior to introducing a sulfur-containing hydrocarbon feed stream into the desulfurization system. Typically, pretreating the sorbent particles prior to utilizing the particles to remove sulfur from a hydrocarbon fluid stream can increase the operating efficiency of the unit and/or extend the useful life of the sorbent itself. Examples of suitable pretreatment processes can include, but are not limited to, heat treatment, moisture removal, oxygen expulsion, and the like. Sometimes, the sorbent is treated during its manufacturing process (i.e., prior to being introduced into the process unit), but, oftentimes, the sorbent must be pretreated in situ (i.e., after its introduction into the unit, but prior to its use in the desulfurization process).

According to one embodiment of the present invention, there is provided an in situ process for presulfiding a plurality of sorbent particles in a desulfurization system. In general, the presulfiding process can include contacting at least a portion of the sorbent particles with a presulfiding agent in a presulfiding zone under presulfiding conditions to thereby provide a plurality of at least partly presulfided sorbent particles. In general, the contacting can be carried out according to any method known in the art. For example, in one embodiment, the sorbent particles can be contacted with the presulfiding agent in a substantially continuous manner, a substantially batch manner, a semi-batch manner, a semi-continuous manner, or any combination thereof.

Generally, the presulfiding conditions can include the temperature, pressure, and average particle contact time in the presulfiding zone, as well as the sulfur loading of the sorbent. In one embodiment, the temperature of the presulfiding zone can be in the range of from about 95° C. (203° F.) to about 815° C. (1499° F.), about 260° C. (500° F.) to about 480° C. (896° F.), or 315° C. (599° F.) to 455° C. (851° F.). The total pressure of the presulfiding zone can be in the range of from about 205 kPa (29.7 psia) to about 10,450 kPa (1,515.6 psia), about 450 kPa (65.2 psia) to about 4,250 kPa (616 psia), or 795 kPa (115 psia) to 1,480 kPa (215 psia). In one embodiment, the average particle residence time in the presulfiding zone can be less than about 30 minutes, less than about 20 minutes, less than about 10 minutes, or less than 5 minutes.

Typically, during the presulfiding process, the desulfurization system, including the presulfiding zone and one or more other zones (i.e., regeneration and/or reduction) can be substantially oxygen-free. In one embodiment, the presulfiding, regeneration, and/or reduction zone can comprise less than about 5 volume percent, less than about 2 volume percent, less than about 1 volume percent, or substantially no oxygen during presulfiding. Optionally, hydrogen and/or an inert gas (such as, for example, nitrogen) may be present in one or more locations of the desulfurization system during presulfiding, including the presulfiding zone itself. In one embodiment, the molar ratio of hydrogen to presulfiding agent (i.e., the hydrogen-to-presulfiding agent molar ratio) can be in the range of from about 0.01 to about 10, about 0.1 to about 6, or 0.5 to 2.

In general, the presulfiding agent can comprise a sulfur compound and, optionally, a generally inert carrier component. Typically both the sulfur compound and the carrier component are fluids and, in one embodiment, can both comprise liquids. In one embodiment, the sulfur compound can comprise an organosulfur compound. Examples of suitable sulfur compounds can include, but are not limited to dimethyl disulfide (DMS), dimethyl sulfoxide (DMSO), dimethyl disulfide (DMDS), methyl mercaptan (MESH), ethyl mercaptan, butyl mercaptan, hydrogen sulfide, and di-tert-nonyl polysulfide (TNPS). In one embodiment, the carrier fluid can be an organic carrier fluid comprising less than about 5 volume percent, less than about 2 volume percent, less than about 1 volume percent, or substantially no olefins. Examples of suitable organic carrier fluids can include, but are not limited to, pure-component or blended hydrocarbon streams comprising straight-chain hydrocarbons having between about 6 and 20 carbon atoms. The concentration of sulfur-containing compound in the presulfiding agent is not limited. In one embodiment, the amount of presulfiding agent in the combined carrier fluid/presulfiding agent stream can be in the range of from about 0.1 to about 25 volume percent, about 0.25 to about 15 volume percent, or 0.5 to 10 volume percent, based on the total weight of the combined stream.

Any solid sorbent particles can be suitable for use with the present invention. In one embodiment, the solid sorbent particles can be any sufficiently fluidizable, circulatable, and regenerable zinc-oxide based composition having sufficient desulfurization activity and sufficient attrition resistance at the operating conditions of the desulfurization system. In one embodiment, the sorbent particles can comprise zinc oxide and a promoter metal component. A description of exemplary sorbent compositions and methods of preparation are provided in U.S. Pat. Nos. 6,429,170 and 7,241,929, the entire disclosures of which are incorporated herein by reference to the extent not inconsistent with the present disclosure.

In one embodiment wherein the sorbent particles comprise a promoter metal component, the promoter metal component can comprise a promoter metal selected from the group consisting of nickel, cobalt, iron, manganese, tungsten, silver, gold, copper, platinum, zinc, tin, ruthenium, molybdenum, antimony, vanadium, iridium, chromium, palladium, rhodium, and mixtures thereof. In one embodiment, at least a portion of the promoter metal component can comprise a reduced-valence promoter metal. As used herein, the term "reduced-valence" refers to a promoter metal having a valence that is less than the valence of the metal in its common oxidized state. For example, in one embodiment wherein the promoter metal comprises nickel, the reduced-valence promoter metal can have a valence less than 2 or zero. According to one embodiment, at least about 65 percent, at least about 75 percent, at least about 90 percent, or substantially all of the promoter component of the sorbent entering reaction zone and/or exiting the reduction zone can comprise a reduced-valence promoter metal.

In one embodiment, the reduced-valence promoter metal component comprises, consists of, or consists essentially of, a substitutional solid metal solution characterized by the formula: $M_AZn_B$, wherein M is the promoter metal and A and B are each numerical values in the range of from about 0.01 to about 0.99. In the above formula for the substitutional solid metal solution, A can be in the range of from about 0.70 to about 0.98 or 0.85 to 0.95 and B can be in the range of from about 0.03 to about 0.30 or 0.05 to 0.15. In one embodiment, A+B=1.

Substitutional solid solutions are a subset of alloys that are formed by the direct substitution of the solute metal for the solvent metal atoms in the crystal structure. For example, it is believed that the substitutional solid metal solution $M_AZn_B$ is formed by the solute zinc metal atoms substituting for the solvent promoter metal atoms. Three basic criteria exist that favor the formation of substitutional solid metal solutions: (1) the atomic radii of the two elements are within 15 percent of each other; (2) the crystal structures of the two pure phases are the same; and (3) the electronegativities of the two components are similar. The promoter metal (as the elemental metal or metal oxide) and zinc (as the elemental metal or metal oxide) employed in the sorbent described herein typically meet at least two of the three criteria set forth above. For example, when the promoter metal is nickel, the first and third criteria, are met, but the second is not. The nickel and zinc metal atomic radii are within 10 percent of each other and the electronegativities are similar. However, nickel oxide (NiO) preferentially forms a cubic crystal structure, while zinc oxide (ZnO) prefers a hexagonal crystal structure. A nickel zinc solid solution retains the cubic structure of the nickel oxide. Forcing the zinc oxide to reside in the cubic structure increases the energy of the phase, which limits the amount of zinc that can be dissolved in the nickel oxide structure. This stoichiometry control manifests itself microscopically in a 92:8 nickel zinc solid solution ($Ni_{0.92}$ $Zn_{0.8}$) that is formed during reduction and microscopically in the repeated regenerability of sorbent.

In addition to zinc oxide and the reduced-valence promoter metal component, the desulfurization sorbent particles can further comprise a porosity enhancer and an aluminate. The aluminate can be a promoter metal-zinc aluminate substitutional solid solution. The promoter metal-zinc aluminate substitutional solid solution can be characterized by the formula: $M_ZZn_{(1-Z)}Al_2O_4$, where M is the promoter metal and Z is a numerical value in the range of from 0.01 to 0.99. The porosity enhancer, when employed, can be any compound which ultimately increases the macroporosity of the solid sorbent particles.

In one embodiment, the porosity enhancer can be perlite. The term "perlite" as used herein is the petrographic term for a siliceous volcanic rock which naturally occurs in certain regions throughout the world. The distinguishing feature, which sets it apart from other volcanic minerals, is its ability to expand four to twenty times its original volume when heated to certain temperatures. When heated above 870° C. (1,598° F.), crushed perlite expands due to the presence of combined water with the crude perlite rock. The combined water vaporizes during the heating process and creates countless tiny bubbles in the heat softened glassy particles. It is these diminutive glass sealed bubbles which account for its light weight. Expanded perlite can be manufactured to weigh as little as 2.5 lbs per cubic foot. Typical chemical analysis properties of expanded perlite are: silicon dioxide 73%, aluminum oxide 17%, potassium oxide 5%, sodium oxide 3%, calcium oxide 1%, plus trace elements. Typical physical properties of expanded perlite include: (1) softening point 870° C. (1,598° F.) to 1,095° C. (2,003° F.); (2) fusion point 1,260° C. (2,300° F.) to 1,343° C. (2,444° F.); (3) pH 6.6 to 6.8; and (4) specific gravity 2.2 to 2.4. The term "expanded perlite" as used herein refers to the spherical form of perlite which has been expanded by heating the perlite siliceous volcanic rock to a temperature above 870° C. (1,598° F.). The term "particulate expanded perlite" or "milled perlite" as used herein denotes that form of expanded perlite which has been subjected to crushing so as to form a particulate mass wherein the particle size of such mass is comprised of at least 97 percent of particles having a size of less than two microns. The term "milled expanded perlite" is intended to mean the product resulting from subjecting expanded perlite particles to milling or crushing.

Typically, the sorbent particles can have a mean particle size in the range of from about 1 to about 500 micrometers (microns) or about 10 to about 300 microns, as determined by using a using a RO-TAP Testing Sieve-Shaker, manufactured by W. S. Tyler, Inc. of Mentor, Ohio, or other comparable sieves. To determine mean particle size, the material to be measured is placed in the top of a nest of standard 8 inch diameter stainless steel framed sieves with a pan on the bottom. The material undergoes sifting for a period of about 10 minutes; thereafter, the material retained on each sieve is weighed. The percent retained on each sieve is calculated by dividing the weight of the material retained on a particular sieve by the weight of the original sample. This information is used to compute the mean particle size, by the method outlined in Chapter 3 of Fluidization Engineering by Kunii and Levenspiel (1987). Typically, the average density of the solid sorbent particles can be in the range of from about 0.5 to about 1.5 grams per cubic centimeter (g/cc), about 0.8 to about 1.3 g/cc, or 0.9 to 1.2 g/cc. In one embodiment, the particle size and density of the sorbent particles qualify the particles as Group A solids under the Geldart group classification system described in *Powder Technology*, vol. 7, pages 285-292 (1973). According to one embodiment, the solid sorbent particles can be in the form of a microsphere.

Prior to contacting the sorbent with presulfiding agent in the presulfiding zone, the sorbent particles can have an initial sulfur loading. Sulfur loading refers to the amount of sulfur sorbed into/onto the sorbent, expressed as weight percent sulfur elemental sulfur. Sulfur loading can be analytically determined according to any analytic method known in the art, including, for example x-ray diffraction, x-ray fluorescence (XRF), and atomic absorption (AA) spectrometry. In one embodiment, the initial sulfur loading of the desulfurization sorbent particles can be less than about 1.75 weight percent sulfur, less than about 1.5 weight percent sulfur, less than about 1.0 weight percent sulfur, less than about 0.75 weight percent sulfur, or less than 0.5 weight percent sulfur.

In general, the presulfiding process can be carried out for any desirable length of time or until one or more system variables achieve a target value. For example, in one embodiment, presulfiding can be carried out until the sorbent particles meet or exceed a target sulfur loading and/or achieve a specified change in sulfur loading. In one embodiment, the target average sulfur loading can be at least about 1.8 weight percent sulfur, at least about 2.0 weight percent sulfur, at least about 2.2 weight percent sulfur, at least about 2.5 weight percent sulfur, or at least 2.8 weight percent sulfur. According to this embodiment, presulfiding could cease once the target sulfur loading had been met.

According to another embodiment, presulfiding can be carried out until the average sulfur loading is changed by a specified amount. For example, presulfiding can continue until the average sorbent sulfur loading increases by a certain percent above the initial sulfur loading (e.g., a 10% change from 1.0 weight percent sulfur to 1.1 wt % sulfur) or until the average sulfur loading is increased by a particular number of percentage points (e.g., a 1 percentage point change from 2 weight percent sulfur to 3 weight percent sulfur). In one embodiment, presulfiding can be carried out until the average sorbent sulfur loading increases by at least about 15 percent, at least about 25 percent, at least about 40 percent from the initial average sorbent sulfur loading. In another embodiment, presulfiding can be carried out until the average sulfur loading increases by at least 0.25 percentage points, at least about 0.5 percentage points, at least about 0.75 percentage points, at least about 1.0 percentage points, or at least 1.25 percentage points. Regardless of the target value selected, the presulfiding process according to one embodiment of the present invention can be completed in less than about 36 hours, less than about 24 hours, less than about 18 hours, less than about 12 hours, less than about 10 hours, or less than 8 hours.

Referring now to FIG. 1, a desulfurization system 110, configured according to one embodiment of the present invention, is illustrated. In general, desulfurization system 110 can be any system capable of at least partially desulfurizing a sulfur-containing hydrocarbon feed stream using a plurality of circulatable solid desulfurization particles. The main components of desulfurization system 110 illustrated in FIG. 1 include a reaction vessel (i.e., a reactor) 120, a sorbent transfer system 130, a regeneration vessel (i.e., a regenerator) 140, an optional reduction vessel (i.e., reducer 150), and a product separation/distillation zone 160. In addition, desulfurization system 110 comprises a sorbent presulfiding system 170, which will be described in further detail shortly.

Reactor 120, regenerator 140, and/or reducer 150 can comprise any vessel from which solid sorbent particles can be added or withdrawn in a batch, semi-batch, semi-continuous, or continuous manner. In general, reactor 120, regenerator 140, and/or reducer 150 can comprise a fluidized particle bed (i.e., a fluidized bed vessel), a fixed particle bed (i.e., a fixed bed vessel), or any combination thereof (i.e., a hybrid vessel). In one embodiment, reactor 120, regenerator 140, and reducer 150 each comprise fluidized particle beds.

Sorbent transfer system 130 can comprise any suitable mechanism to transfer at least a portion of the solid sorbent particles employed in desulfurization system 110 between reactor 120, regenerator 140, and/or reducer 150. In one embodiment illustrated in FIG. 1, sorbent transfer system 130 comprises a reactor receiving vessel (i.e., receiver) 132, a reactor-side transfer/stripping vessel 134, a regenerator receiving vessel (i.e., receiver) 136, and a regenerator-side transfer/stripping vessel 138.

Product separation/distillation zone 160 can comprise any process scheme and/or related process equipment required to further process the desulfurized product stream exiting reactor 120 in order to achieve one or more desired product specifications. In one embodiment, product separation/distillation zone 160 can comprise at least separation vessel or column operable to remove relatively more volatile materials (i.e., hydrogen, nitrogen, methane, ethane, and the like) from the relatively less volatile desulfurized hydrocarbon material. In addition, product separation/distillation zone 160 can comprise any number and configuration of heat exchangers and other similar equipment as known in the art in order to produce a desulfurized product stream having the desired temperature and/or vapor fraction.

Sorbent presulfiding system 170 can be any system capable of supplying a compound capable of presulfiding at least a portion of the sorbent utilized in desulfurization system 110. In general, sorbent presulfiding system 170 can comprise any process equipment necessary to generate and/or deliver a presulfiding agent to the presulfiding zone defined within desulfurization system 110. In one embodiment illustrated in FIG. 1, sorbent presulfiding system 170 comprises a carrier fluid tank 172, a sulfur compound tank 174, and a mix pump 176 to combine the sulfur-containing compound with the carrier fluid prior to introducing the presulfiding agent into reactor 120.

Desulfurization system 110, as illustrated in FIG. 1, can be operated in two distinct modes: a first, sorbent pretreatment mode and a second, hydrocarbon desulfurization mode. In general, during the pretreatment mode, at least a portion of the sorbent particles employed in desulfurization system 110 can be contacted with a presulfiding agent to thereby provide a plurality of presulfided sorbent particles. During the desulfurization mode of operation, at least a portion of the presulfided sorbent particles can be contacted with and can at least partially desulfurize a hydrocarbon feed stream. Thereafter, the resulting sulfur-laden sorbent particles can be regenerated and optionally reactivated (i.e., reduced) prior to reentering the desulfurization zone.

Operating in and transitioning between the two primary modes of operating desulfurization system 110 generally involves isolating and deisolating various parts of the system using a plurality of isolation devices. In one embodiment, the isolation devices can include isolation valves that are manually and/or automatically controlled. In one embodiment depicted in FIG. 1, desulfurization system 110 can comprise a hydrocarbon feed stream isolation valve 310, a desulfurized product stream isolation valve 320, an internal recycle stream isolation valve 330, a sorbent pretreatment system isolation valve 340, isolation valves for each storage tank (e.g., carrier tank isolation valve 342 and presulfiding agent tank isolation valve 344 for the system depicted in FIG. 1), and a regeneration gas stream isolation valve 350. Table 1, below, summarizes the valve positions for each of the above isolation valves during both the sorbent pretreatment and desulfurization modes of operation.

TABLE 1

| Operating | Isolation Valve Reference Numeral | | | | | | |
|---|---|---|---|---|---|---|---|
| Mode | 310 | 320 | 330 | 340 | 342 | 344 | 350 |
| Pretreatment | C | C | O | O | O | O | C |
| Desulfurization | O | O | C | C | C | C | O |

Valve Position: Open (O) or Closed (C)

Figure 2:
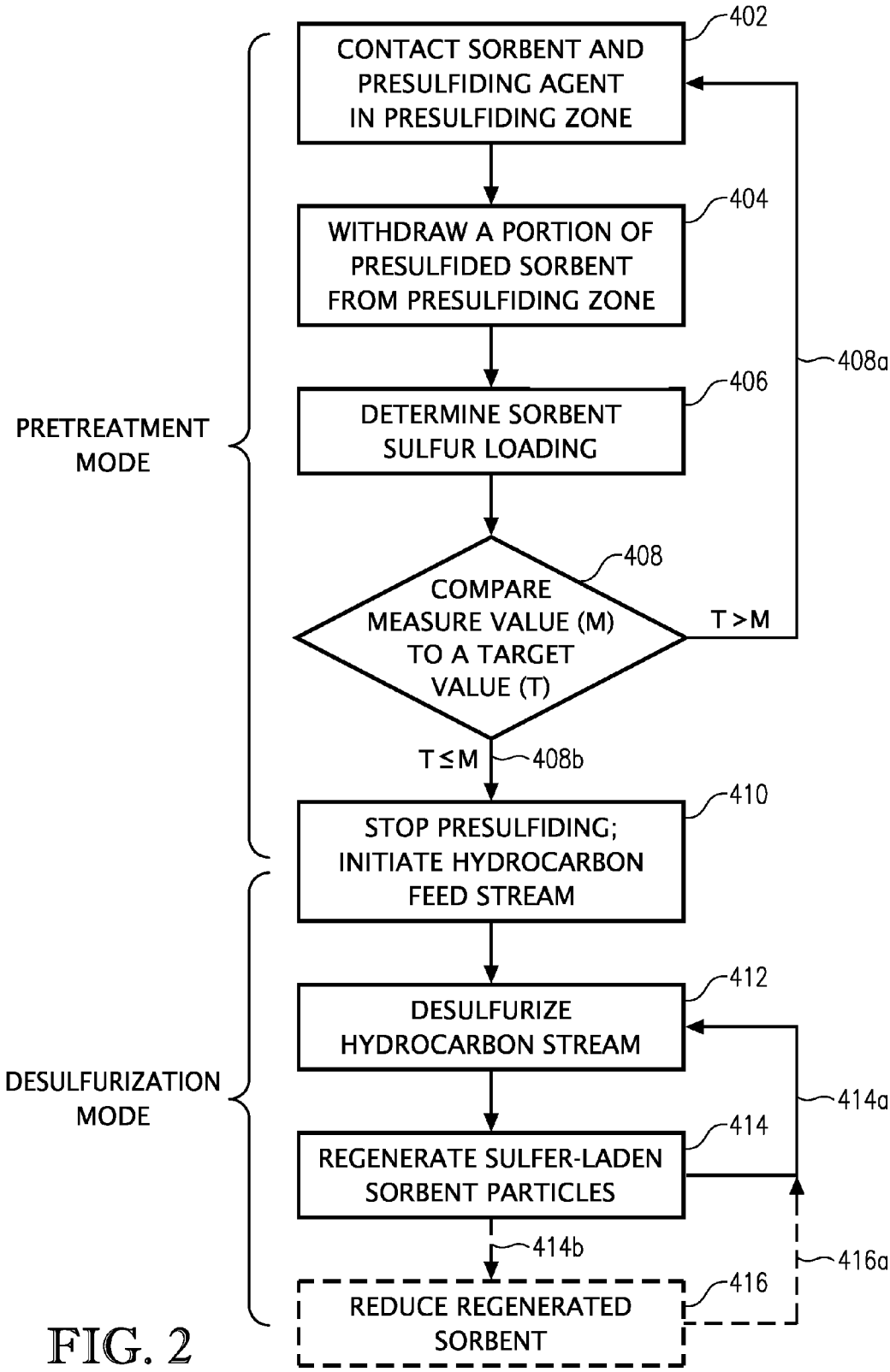
FIG. 2 is a flow chart of steps involved in the operation of the desulfurization system illustrated in FIG. 1, according to one embodiment of the present invention.

During each of the steps of the sorbent pretreatment mode of operation, described in detail shortly with reference to FIG. 2, the isolation valves associated with sorbent pretreatment system 170 (i.e., valves 340, 342, and 344) and internal recycle valve 330 remain open, while hydrocarbon feed and product isolation valves 310 and 320 and regeneration gas isolation valve 350 are maintained in the closed position. As a result, sorbent and fluid streams circulating through desulfurization system 110 during this mode of operation are only circulated internally; substantially no feed streams enter desulfurization system 110 and substantially no product streams are produced from desulfurization system 110 during this mode of operation.

Conversely, during the desulfurization mode of operation, the hydrocarbon feed stream isolation valve 310, the desulfurized hydrocarbon product stream isolation valve 320, and regeneration gas isolation valve 330 remain open, while the sorbent pretreatment system valves 340, 342, and 344 and internal recycle valve 330 are closed. In contrast to the pretreatment mode of operation, substantially no fluid stream are internally circulated within desulfurization system 110 during this mode of operation; rather, an external feed stream can be introduced into desulfurization system 110, while a product stream produced from desulfurization system 110 can be routed to a subsequent location for further processing and/or storage.

The pretreatment and desulfurization modes of operation of desulfurization system 110 illustrated in FIG. 1 will now be described in more detail with respect to the flow chart provided in FIG. 2. In particular, FIG. 2 outlines the major steps involved in operating desulfurization system 110 illustrated in FIG. 1 during both operating modes.

The first step of the pretreatment operating mode, represented by block 402 in FIG. 2, includes presulfiding at least a portion of the desulfurization particles employed in desulfurization system 110 via contact with a presulfiding agent in a presulfiding zone under presulfiding conditions. In one embodiment illustrated in FIG. 1, this step can be carried out by combining a stream of sulfur compound withdrawn from tank 174 via conduit 210 with a carrier fluid stream withdrawn from tank 172 via conduit 212. Specific examples of carrier fluids and sulfur compounds are discussed in greater detail above. As shown in FIG. 1, the combined stream in conduit 214 can then be introduced into conduit 218 and can subsequently be combined with an optional hydrogen stream in conduit 216 prior to entering the suction port of reactor pump 112. The combined stream discharged from pump 112 can be warmed via indirect heat exchange in reactor heater 114 before entering reactor 120, as shown in FIG. 1.

The second step in the pretreatment mode of operation, represented by block 404 in FIG. 2, comprises withdrawing at least a portion of the at least partially presulfided sorbent from the presulfiding zone. In one embodiment, at least a portion of the withdrawn sorbent can subsequently be introduced into regenerator 140. According to one embodiment illustrated in FIG. 1, the withdrawn sorbent can first be passed through sorbent transfer system 130, which will be discussed in greater detail shortly.

According to FIG. 1, at least a portion of the sorbent withdrawn from sorbent transfer system 130 can subsequently be introduced into regenerator 140. During the pretreatment mode of operation, the average regenerator temperature can be less than about 255° C., less about 250° C., less than about 200° C., less than about 175° C., or less than 150° C. In addition, during the pretreatment mode of operation, regenerator 140 can be substantially oxygen-free. This is in direct contrast to the desulfurization mode of operation, in which the regenerator is maintained at a substantially higher average temperature and in an oxygen-containing environment. The desulfurization mode of operation will be discussed in detail shortly. As a result of the lower operating temperatures maintained in regenerator 140 during the sorbent presulfiding step, substantially none of the sorbed sulfur is removed as the sorbent passes through the regenerator (i.e., substantially none of the sorbent is regenerated). In one embodiment, the sulfur loading of the at least partly sulfided sorbent particles introduced into regenerator 140 via conduit 234 can be within about 10 percent, within about 8 percent, within about 5 percent, within about 2 percent, or within 1 percent of the sulfur loading of the at least partly sulfided sorbent particles withdrawn from regenerator 140 via conduit 240.

As shown in FIG. 1, the at least partly sulfided sorbent withdrawn from regenerator 140 can subsequently be routed back through sorbent transfer system 130 prior to optionally passing through reducer 150, which will be discussed in more detail in a subsequent section. Thereafter, the at least partly sulfided particles can then be introduced into reactor 120, wherein the at least a portion of the sorbent particles can re-contact the presulfiding agent recycled back to the inlet of reactor 120 from product separation/distillation zone 160 via recycle conduit 224, as shown in FIG. 1.

The next step of the sorbent pretreatment operating mode, represented by block 406 in FIG. 2, is to directly or indirectly determine the sulfur loading of the sorbent particles exiting the presulfiding zone. In one embodiment, the sulfur loading can be determined by withdrawing a sorbent sample from desulfurization system 110 and directly measuring the sulfur loading using one of the analytical techniques mentioned previously (i.e., XRD, XRF, AA spectrometry, and the like). In another embodiment, determining the average sorbent sulfur loading can also include measuring the value of one or more process variables that indirectly correlate to the weight percent sorbed sulfur. Examples of process variables correlating to the sorbent sulfur loading can include, but are not limited to, regenerator and/or reactor effluent composition and average reactor temperature.

Next, the measured value (M) for sorbent sulfur loading (or other process variable corresponding thereto) can be compared with an appropriate target value (T), as shown by block 408 in FIG. 2. The exact target value can differ based on specific system configurations and the variable itself, examples of suitable target values for average sorbent sulfur loadings were discussed previously. If the measured value, M, is greater than about 5 percent, greater than about 8 percent, or greater than about 10 percent different than the target value, T, at least a portion of the sorbent particles withdrawn from regenerator 140 can be reintroduced into reactor 120 and desulfurization system 110 can continue to operate in the pretreatment mode, as represented by option 408*a* in FIG. 2. If the measured value, M, is within about 10 percent, within about 8 percent, within about 5 percent, or within 2 percent of the target value, T, desulfurization system 110 can be transitioned into the desulfurization mode of operation. The desulfurization mode of operation will now be described in more detail with respect to FIGS. 1 and 2.

As shown in block 410 in FIG. 2, the transition from the pretreatment mode to the desulfurization mode of operation, can include the steps of discontinuing the presuldifing agent injection and initiating the flow of a hydrocarbon feed stream into desulfurization system 110. In one embodiment, these steps can be carried out by first isolating sorbent presuldifing system 170 and recycle conduit 224 from reactor 120 by closing isolation valves 330, 340, 342, and 344, as shown in Table 1 above. In addition, the flow of hydrocarbon feed into desulfurization system 110 can be initiated by deisolating hydrocarbon feed stream conduit 250, desulfurized product stream conduit 254, and regeneration gas conduit 236 by opening valves 310, 320, and 350, as shown in FIG. 1.

During the desulfurization mode of operation, as shown by block 412 in FIG. 2, a hydrocarbon feed stream in conduit 250 in FIG. 1 can be introduced into reactor 120. In one embodiment of the present invention, the sulfur-containing hydrocarbon feed stream in conduit 250 can comprise gasoline, diesel, or a combination thereof. Gasoline typically comprises a mixture of hydrocarbons having a boiling point in the range of from about 35° C. (95° F.) to about 260° C. (500° F.). In general, gasolines comprise in the range of from about 5 to about 50 weight percent, about 10 to about 35 weight percent, or 15 to 25 weight percent of olefins and/or in about 10 to about 55, about 15 to about 45 weight percent, or 20 to 40 weight percent aromatics, based on the total weight of the gasoline stream. Examples of gasolines include, but are not limited to, naphthas such as straight-naphtha, coker naphtha, catalytic gasoline, visbreaker naphtha, alkylate, isomerate, and reformate and/or catalytically- or thermally-cracked gasolines such as coker gasoline, visbreaker gasoline, fluidized catalytic cracker (FCC) gasoline, heavy oil cracker (HOC) gasoline, hydrocracker gasoline. Diesel fuel can generally be characterized as having a boiling point in the range of from about 150° C. (302° F.) to about 400° C. (752° F.), and generally comprises in the range of from about 10 to about 90 weight percent, about 20 to about 80 weight percent, or 15 to 60 weight percent aromatics and/or less than about 10 weight percent, less than about 5 weight percent, or substantially no olefins. Examples of diesel fuels can include, but are not limited to, light cycle oil, kerosene, jet fuel, straight-run diesel, hydrotreated diesel, and combinations thereof. In one embodiment, the gasoline and/or diesel fuel in conduit 250 may have previously been fractionated and/or hydrotreated in an upstream unit (not shown) prior to entering reactor 120.

In one embodiment, the hydrocarbon feed stream in conduit 250 can comprise one or more sulfur-containing compounds, which can include, but are not limited to, hydrogen sulfide ($H_2S$), carbonyl sulfide (COS), carbon disulfide ($CS_2$), mercaptans (RSH), organic sulfides (R—S—R), organic disulfides (R—S—S—R), thiophene, substituted thiophenes, organic trisulfides, organic tetrasulfides, benzothiophene, alkyl thiophenes, alkyl benzothiophenes, alkyl dibenzothiophenes, and combinations thereof. In general, R can be an alkyl, cycloalkyl, or aryl group comprising in the range of from about 1 to about 15 carbon atoms. In one embodiment, the feed stream in conduit 250 can have a sulfur content greater than about 50 parts per million by weight (ppmw), or in the range of from about 100 to about 10,000 ppmw, about 150 to about 5,000 ppmw, based on the total weight of the stream. Sulfur content refers to the amount of atomic sulfur in the sulfur-containing compounds and can be determined according to various ASTM standard methods, including, for example, ASTM D 2622 Standard Test Method for Sulfur in Petroleum Products by Wavelength Dispersive X-ray Fluorescence Spectrometry or ASTM D 5453 Standard Test Method for Determination of Total Sulfur in Light Hydrocarbons, Spark Ignition Engine Fuel, Diesel Engine Fuel, and Engine Oil by Ultraviolet Fluorescence. In another embodiment, at least about 50 weight percent, at least about 75 weight percent, or at least about 90 weight percent of the total mass of atomic sulfur in the sulfur-containing feed stream in conduit 250 can comprise organosulfur compounds.

Prior to entering reactor 120, the pressure of the hydrocarbon stream can be increased via reactor pump 112 and the pressurized hydrocarbon stream can be heated and at least partially vaporized via indirect heat exchange in reactor heater 114. In one embodiment, at least about 90 percent, at least about 95 percent, at least about 98 percent, or substantially all of the sulfur-containing hydrocarbon stream exiting reactor heater 114 and/or introduced into reactor 120 via conduit 220 can be in the vapor phase.

Once introduced into reactor 120, the sulfur-containing, at least partially vaporized hydrocarbon stream can be contacted with a plurality of presulfided sorbent particles under desulfurization conditions, thereby desulfurizing at least a portion of the hydrocarbon stream. In general, the desulfurization conditions employed in reactor 120 include a total pressure, temperature, and weight hour space velocity. In one embodiment, the average temperature in reactor 120 during the desulfurization mode of operation can be in the range of from about 95° C. (203° F.) to about 815° C. (1499° F.), about 260° C. (500° F.) to about 480° C. (896° F.), or 315° C. (599° F.) to 455° C. (851° F.). The total pressure can be in the range of from about 205 kPa (29.7 psia) to about 10,450 kPa (1,515.6 psia), about 450 kPa (65.2 psia) to about 4,250 kPa (616 psia), or 795 kPa (115 psia) to 1,480 kPa (215 psia). Weight hourly space velocity (WHSV) measures the mass flow rate (kg/h) at standard temperature and pressure (STP) per kilogram of sorbent present in the desulfurization zone of reactor 120. In one embodiment, the WHSV in reactor 120 can be in the range of from about 0.5 $h^{-1}$ to about 50 $h^{-1}$ or about 1 $h^{-1}$ to about 20 $h^{-1}$.

Optionally, other reactants, either alone or as diluents, can be introduced into reactor 120. For example, in one embodiment, an additional reactant stream comprising at least about 25 volume percent, at least about 50 percent, at least about 75 percent, or at least 90 percent hydrogen can be introduced into the desulfurization zone of reactor 120. In one embodiment, the hydrogen-containing stream can be introduced directly into reactor 120. In another embodiment, the hydrogen-containing stream in conduit 216 can be combined with the sulfur-containing hydrocarbon feed stream in conduit 250 prior to entering reactor 120. In general, high purity hydrogen may not be required and diluents, such as, for example, methane, carbon dioxide, flue gas, nitrogen, and combinations thereof can additionally be present in the hydrogen-containing stream introduced into the desulfurization zone. The total amount of hydrogen introduced into reactor 120 can generally be such that the mole ratio of hydrogen to sulfur-containing fluid can be in the range of from about 0.01:1 to about 100:1, about 0.1:1 to about 10:1, or 0.2:1 to 2:1.

When the sorbent composition is contacted with the sulfur-containing hydrocarbon fluid in the desulfurization zone, at least a portion of the sulfur compounds in the sulfur-containing stream can be removed therefrom. While not wishing to be bound by theory, it is believed that at least a portion of the sulfur removed from the sulfur-containing fluid can be employed to convert at least a portion of the zinc oxide of the sorbent composition to zinc sulfide. In contrast to most conventional sulfur removal processes (e.g., hydrodesulfurization), substantially none of the sulfur removed from the sulfur-containing feed stream is converted to hydrogen sulfide. Rather, in one embodiment, the mass flow rate of hydrogen sulfide exiting reactor 120 via conduit 222 and/or exiting product separation/distillation zone 160 via conduit 254 can be less than about 200 percent, less than about 150 percent, or less than 100 percent of the mass flow rate of hydrogen sulfide entering reactor 120 via conduit 250.

After removing at least a portion of the sulfur from the hydrocarbon feed stream in the desulfurization zone of reactor 120, the now sulfur-laden sorbent and the sulfur-depleted hydrocarbon effluent stream can be separated according to any manner or method known in the art. Examples of solid/fluid separation mechanisms include, but are not limited to, cyclonic devices, settling chambers, impingement devices, filters, and combinations thereof. Once the desulfurized hydrocarbon effluent stream exits reactor 120 via conduit 222, at least a portion of the stream can be cooled and condensed using downstream processing equipment located in product separation and distillation zone 160. In one embodiment illustrated in FIG. 1, a recycle hydrogen stream withdrawn from product separation/distillation zone 160 via conduit 216 can be recycled back to combine with the hydrocarbon feed stream in the above-discussed molar ratio, while a desulfurized product stream in conduit 254 can be routed out of desulfurization unit 110 to a downstream location for further processing, storage, and/or use.

According to one embodiment, the desulfurized product stream in conduit 254 can have an atomic sulfur content less than about 50 ppmw, less than about 20 ppm, less than about 15 ppmw, less than about 10 ppmw, or less than 5 ppmw, based on the total weight of the stream. Typically, this represents an overall sulfur removal efficiency greater than about 50 percent, greater than about 80 percent, greater than about 90 percent, or greater than about 95 percent, wherein sulfur removal efficiency is defined according to the following formula: (mass of sulfur entering reactor 120 via stream 250—mass of sulfur exiting reactor 120 via stream 254)/(mass of sulfur entering reactor 120 via conduit 250), expressed as a percentage.

As illustrated in FIG. 1, at least a portion of the separated, sulfur-laden sorbent particles exiting reactor 120 via conduit 230 can be routed to sorbent transfer system 130. In one embodiment, the average sulfur loading of the sulfur-laden particles in conduit 230 during the desulfurization mode of operation can be at least about 2 weight percent sulfur, or can be in the range of from about 2.5 to about 6 weight percent sulfur, or 3 to 5.5 weight percent sulfur. As shown in FIG. 1, the sulfur-laden sorbent can be routed via conduit 230 to a first receiver 132. In one embodiment, first receiver 132 can be a holding or storage vessel. Thereafter, at least a portion of the sorbent in first receiver can flow via gravity, lift gas, or a combination thereof, to a first stripping vessel 134. In one embodiment, first stripping vessel 134 can define a stripping zone operable to remove a portion or substantially all of the residual hydrocarbon material from the sorbent particles. The stripping zone can employ a stripping agent (e.g., nitrogen) and can be operated at a temperature in the range of from about 35° C. (95° F.) to about 535° C. (995° F.) and a pressure in the range of from about 275 kPa (39.9 psia) to about 3,550 kPa (515 psia). Stripping can be carried out for a period of time sufficient to achieve the desired level of stripping, which can generally be in the range of from about 0.1 to about 4 hours or about 0.3 to 1 hour.

As illustrated in FIG. 1, at least a portion of the particles exiting sorbent transfer system 130 can subsequently be introduced into regenerator 140, wherein at least a portion of the sorbent can be regenerated via contact with a regeneration gas stream under regenerating conditions, as represented by block 414 in FIG. 2. During the desulfurization mode of operation, the average temperature of regenerator 140 can be in the range of from about 95° C. (203° F.) to about 815° C. (1499° F.), about 260° C. (500° F.) to about 650° C. (1202° F.), or 455° C. (851° F.) to 590° C. (1094° F.). The average overall pressure in regenerator 140 can be in the range of from about 175 kPa (25.4 psia) to about 10,450 kPa (1515.6 psia), or 205 kPa (29.7 psia) to about 795 kPa (115 psia). Typically, sorbent particles can have an average residence time in regenerator 140 that can be in the range of from about 0.1 to about 24 hours or 0.3 to 5 hours.

In one embodiment, the regeneration gas stream introduced into regenerator 140 via conduit 236 can comprise an oxygen-containing regeneration gas stream. Typically, the oxygen-containing regeneration gas stream can comprise at least about 15 volume percent, at least about 20 volume percent, or at least 50 volume percent oxygen. Upon contact with the regeneration gas stream under the regeneration conditions described above, at least a portion of the zinc sulfide associated with the sulfur-laden sorbent can be converted to zinc oxide, thereby reducing the average sorbent sulfur loading. In one embodiment, the average sulfur loading of the sulfur-laden particles introduced into regenerator 140 can be at least 10 percent higher, at least about 15 percent higher, at least about 25 percent higher, or at least 40 percent higher than the average sulfur loading of the regenerated particles withdrawn from regenerator 140. Typically, the average sulfur loading of the regenerated particles exiting regenerator 140 via conduit 240 can be in the range of from about 0.1 to about 4 weight percent, about 0.5 to about 3.5 weight percent, or 0.75 to 3 weight percent. Additionally, regenerator 140 can be operable to remove at least a portion of any residual hydrocarbon deposits present in or on the sorbent particles during the regeneration step represented by block 414 in FIG. 2.

In one embodiment, at least a portion of the promoter metal component of the sorbent composition can be returned to its common oxidized (i.e., unreduced) state during the regeneration step of the desulfurization operating mode, described in detail above. In one embodiment, the unreduced promoter metal component of the regenerated sorbent can comprise a substitutional solid metal oxide solution characterized by the formula $M_XZn_YO$, wherein M is the promoter metal and X and Y are in the range of from about 0.01 to about 0.99. In one embodiment, X can be in the range of from about 0.5 to about 0.9, about 0.6 to about 0.8, or 0.65 to 0.75 and Y can be in the range of from about 0.10 to about 0.5, about 0.2 to about 0.4, or 0.25 to 0.35. In general, X+Y=1. Table 2, below, summarizes an unreduced sorbent composition according to one embodiment of the present invention.

TABLE 2

| | Unreduced Sorbent Composition (wt %) | | | |
|---|---|---|---|---|
| Range | ZnO | $M_XZn_YO$ | PE | $M_ZZn_{(1-Z)}Al_2O_4$ |
| Broad | 10-90 | 5-70 | 2-50 | 2-50 |
| Intermediate | 20-70 | 10-60 | 5-30 | 5-30 |
| Narrow | 35-45 | 25-35 | 10-20 | 10-20 |

As shown in FIG. 1, at least a portion of the regenerated sorbent particles exiting regenerator 140 via conduit 240 can subsequently be routed to sorbent transfer system 130, wherein the particles can enter a second receiver 136 and/or a second stripping vessel 138. Second receiving vessel and second stripping vessel 136, 138 can be similar in structure and function to respective first receiving vessel and first stripping vessel 132, 134 described in detail above. In one embodiment, second stripping vessel 138 can be operable to remove at least a portion or substantially all of any residual oxygen contained within the regenerated sorbent composition therein.

In one embodiment, represented by option line 414*a* in FIG. 2, at least a portion of the regenerated sorbent particles exiting sorbent transfer system 130 can be routed back into reactor 120. In another embodiment, represented by option line 414*b* in FIG. 2, prior to being reintroduced into reactor 120, at least a portion of the regenerated sorbent exiting sorbent transfer system 130 can be routed to an optional reduction zone, illustrated by reducer 150 in FIG. 1. In general, reducer 150 can be operable to at least partially reduce or "reactivate" at least a portion of the sorbent particles via contact with a hydrogen-containing reduction gas stream under reduction conditions. Typically, the reduction conditions employed in the activation zone of reducer 150 can include a temperature in the range of from about 150° C. (302° F.) to about 540° C. (1004° F.), about 260° C. (500° F.) to about 480° C. (896° F.), or 315° C. (599° F.) to 455° C. (851° F.) and a pressure in the range of from about 175 kPa (25.4 psia) to about 10,450 kPa (1515.6 psia), or 205 kPa (29.7 psia) to about 795 kPa (115 psia). Typically, the average residence time of a sorbent particle in reducer 150 can be in the range of from about 0.1 hours to about 40 hours, about 0.2 hours to about 10 hours, or 0.5 hours to 1 hour. In one embodiment, the reduction gas stream comprises at least about 25 volume percent, at least about 50 volume percent, at least about 90 volume percent, or at least 95 volume percent hydrogen.

Table 3, below, summarizes broad, intermediate, and narrow ranges for the amount of zinc oxide, reduced-valence promoter metal component ($M_AZn_B$), porosity enhancer (PE), and promoter metal-zinc aluminate ($M_ZZn_{(1-Z)}Al_2O_4$) in the reduced sorbent composition exiting reducer 150, according to one embodiment of the present invention.

TABLE 3

| | Reduced Sorbent Composition (wt %) | | | |
|---|---|---|---|---|
| Range | ZnO | $M_AZn_B$ | PE | $M_ZZn_{(1-Z)}Al_2O_4$ |
| Broad | 10-90 | 5-80 | 2-50 | 2-50 |
| Intermediate | 20-60 | 10-60 | 5-30 | 5-30 |
| Narrow | 30-40 | 30-40 | 10-20 | 10-20 |

As shown by option line 416 in FIG. 2, once the sorbent particles have been reactivated, the at least a portion of the reduced particles can be reintroduced into reactor 120 via conduit 248 as shown in FIG. 1. Thereafter, desulfurization system 110 can continue to operate in the desulfurization mode, as discussed in detail above.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

DEFINITIONS

As used herein, the terms "a," "an," "the," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise" provided above.

As used herein, the term "closed" refers to a valve that is greater than 75 percent, greater than 85 percent, greater than 95 percent, or greater than 99 percent closed.

As used herein, the term "cracked-gasoline" denotes a mixture of hydrocarbons boiling in a range of from about 35° C. to about 260° C., or any fraction thereof, that are products of either thermal or catalytic processes that crack larger hydrocarbon molecules into smaller molecules.

As used herein, the term "diesel fuel" denotes a mixture of hydrocarbons boiling in a range of from about 150° C. to about 400° C., or any fraction thereof.

As used herein, the term "gasoline" denotes a mixture of hydrocarbons boiling in a range of from about 35° C. to about 260° C., or any fraction thereof.

As used herein, the terms "having," "has," and "have" have the same open-ended meaning as "comprising," "comprises," and "comprise" provided above.

As used herein, the terms, "including," "include," and "included" have the same open-ended meaning as "comprising," "comprises," and "comprise" provided above.

As used herein, the term "reduced-valence promoter metal component" refers to a promoter metal component having a valence with is less than the valence of the promoter metal component in its common oxidized state.

As used herein, the term "regeneration conditions" refer to conditions necessary to remove at least a portion of sorbed sulfur from the sulfur-laden sorbent.

As used herein, the term "sorb" refers to any type or combination of physical and/or chemical adsorption and/or absorption.

CLAIMS NOT LIMITED TO THE DISCLOSED EMBODIMENTS

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for removing sulfur from a hydrocarbon feed stream in a desulfurization system, wherein said desulfurization system comprises a reactor and a regenerator, said process comprising:

(a) contacting a plurality of sorbent particles with a presulfiding agent under presulfiding conditions in said reactor to thereby provide a plurality of at least partly sulfided sorbent particles;

(b) introducing at least a portion of said at least partly sulfided sorbent particles into said regenerator;

(c) withdrawing at least a portion of said at least partly sulfided sorbent particles from said regenerator;

(d) returning at least a portion of said at least partly sulfided sorbent particles withdrawn from said regenerator to said reactor;

(e) repeating steps (a) through (d) until said at least partly sulfided sorbent particles introduced into said regenerator have an average sulfur loading that is at least 15 percent greater than the initial average sulfur loading of said sorbent particles prior to said contacting of step (a); and (f) subsequent to step (e), contacting said at least partly sulfided sorbent particles with said hydrocarbon feed stream under desulfurization conditions in said reactor to thereby provide a sulfur-depleted effluent stream and a sulfur-laden sorbent, wherein the average sulfur loading of said at least partly sulfided sorbent particles introduced into said regenerator in step (b) is within 5 percent of the average sulfur loading of the at least partly sulfided sorbent particles withdrawn from said regenerator in step (c).

2. The process of claim 1, wherein said regenerator has an average temperature of less than 250° C. during steps (b) and (c).

3. The process of claim 2, wherein said presulfiding conditions include a hydrogen-to-presulfiding agent molar ratio in the range of from about 0.01 to about 1.0.

4. The process of claim 1, wherein steps (b) and (c) are carried out in a substantially oxygen-free environment.

5. The process of claim 1, wherein said repeating of step (e) is carried out for a period of time less than about 36 hours.

6. The process of claim 1, wherein the mass flow rate of hydrogen sulfide in said sulfur-depleted effluent stream exiting said reaction zone is less than 150 percent of the mass flow rate of hydrogen sulfide in said hydrocarbon feed stream.

7. The process of claim 1, further comprising, prior to step (a), combining said presulfiding agent with a carrier fluid to thereby provide a combined fluid, wherein at least a portion of said combined fluid is contacted with said sorbent particles during the contacting of step (a).

8. The process of claim 7, wherein said carrier fluid is an organic carrier fluid comprising less than 2 volume percent olefins.

9. The process of claim 1, wherein said presulfiding agent comprises an organosulfur compound.

10. The process of claim 9, wherein said presulfiding agent comprises dimethyldisulfide.

11. The process of claim 1, wherein said initial average sulfur loading of said sorbent particles is less than 1.75 weight percent prior to said contacting of step (a).

12. The process of claim 1, wherein steps (a) through (d) are carried out in a substantially continuous manner.

13. The process of claim 1, wherein said hydrocarbon feed stream introduced in step (e) comprises in the range of from about 100 to about 10,000 parts per million by weight (ppmw) of sulfur, wherein said sulfur-depleted effluent stream comprises less than about 50 ppmw of sulfur.

14. The process of claim 1, wherein said sulfur-laden sorbent has an average sulfur loading of at least 2.0 weight percent.

15. The process of claim 1, wherein said hydrocarbon feed stream comprises gasoline.

16. The process of claim 1, wherein said hydrocarbon feed stream comprises diesel.

17. The process of claim 1, further comprising, subsequent to step (f), regenerating at least a portion of said sulfur-laden sorbent under regeneration conditions in said regenerator to thereby provide a regenerated sorbent, wherein said regenerating reduces the average sulfur loading of said sulfur-laden sorbent introduced into said regenerator by at least 10 percent.

18. The process of claim 17, wherein said regenerated sorbent has an average sulfur loading in the range of from about 0.1 to about 4 weight percent.

19. The process of claim 17, wherein said regenerating includes contacting said sulfur-laden sorbent with an oxygen-containing regeneration stream.

20. The process of claim 17, wherein said regeneration conditions include a regenerator temperature in the range of from about 260° C. to about 650° C.

21. The process of claim 20, further comprising, reducing at least a portion of said regenerated sorbent in a reduction zone under reducing conditions to thereby provide a reduced sorbent particles and introducing at least a portion of said reduced sorbent particles into said reactor.

22. The process of claim 21, wherein said desulfurization system further comprises a reduction vessel, wherein at least a portion of said reducing is carried out in said reduction vessel.

23. The process of claim 1, wherein said sorbent particles comprise a support component and a promoter metal component.

24. The process of claim 23, wherein said support component comprises zinc oxide.

25. The process of claim 23, wherein said promoter metal component comprises a single promoter metal.

26. The process of claim 25, wherein said promoter metal is nickel.

27. The process of claim 1, wherein said sorbent particles have a Group A Geldart characterization.

28. The process of claim 1, wherein said sorbent particles have an average particle size of less than 500 microns.

29. A process for desulfurizing a sulfur-containing hydrocarbon feed stream, said process comprising:

(a) introducing a plurality of sorbent particles into a reaction zone, wherein said sorbent particles have an average sulfur loading of less than 1.75 weight percent;

(b) contacting at least a portion of said sorbent particles with a presulfiding agent in said reaction zone under presulfiding conditions to thereby provide a plurality of at least partly sulfided sorbent particles;

(c) intermediate to step (b), passing at least a portion of said at least partly sulfided sorbent through said regeneration zone and routing at least a portion of the sorbent exiting said regeneration zone back into said reaction zone, wherein the average sulfur loading of said sorbent is reduced by less than 10 percent during said passing, (d) repeating step (b) out until said at least partly sulfided sorbent particles have an average sulfur loading greater than 2.0 weight percent;

(e) subsequent to step (d), introducing said hydrocarbon feed stream into said reaction zone;

(f) contacting at least a portion of said at least partly sulfided sorbent particles with at least a portion of said hydrocarbon feed stream in said reaction zone under desulfurization conditions to thereby provide a sulfur-laden sorbent and a sulfur-depleted effluent stream;

(g) regenerating at least a portion of said sulfur-laden sorbent in a regeneration zone under regeneration conditions to thereby provide a regenerated sorbent composition; and (h) introducing at least a portion of said regenerated sorbent composition back into said reaction zone.

30. The process of claim 29, wherein said regeneration zone is substantially oxygen-free during said passing.

31. The process of claim 29, wherein said regeneration zone has a temperature less than 255° C. during said passing.

32. The process of claim 29, further comprising, subsequent to step (e) and prior to step (f), reducing at least a portion of said regenerated sorbent in a reduction zone to thereby provide a reduced sorbent, wherein said at least a portion of said regenerated sorbent introduced back into said reaction zone comprises at least a portion of said reduced sorbent.

33. The process of claim 32, wherein said reduction zone is at least partially defined in a reduction vessel, wherein said reaction zone is not defined within said reduction vessel.

34. The process of claim 29, wherein the mass flow rate of hydrogen sulfide in the sulfur-depleted effluent stream exiting said reaction zone is less than 100 percent of the mass flow rate of hydrogen sulfide in said hydrocarbon feed stream.

35. The process of claim 29, wherein said contacting of step (b) is carried out for a period of time less than about 36 hours.

36. The process of claim 29, wherein said presulfiding agent comprises an organosulfur compound.

37. The process of claim 29, further comprising, prior to step (a), combining said presulfiding agent with an organic carrier fluid to thereby provide a combined fluid, wherein at least a portion of said combined fluid is utilized in said contacting of step (b).

38. The process of claim 37, wherein said organic carrier fluid comprises less than 2 volume percent olefins.

39. The process of claim 29, wherein said reaction zone is at least partially defined within a fluidized bed reactor, wherein said regeneration zone is at least partially defined within a fluidized bed regenerator.

40. The process of claim 39, wherein said desulfurization conditions of step (d) include a reactor temperature in the range of from about 260 to about 480° C., wherein said regeneration conditions of step (e) include a regenerator temperature in the range of from about 260 to about 650° C.

41. The process of claim 29, wherein said hydrocarbon feed stream introduced into said reaction zone in step (e) comprises in the range of from about 100 to about 10,000 parts per million by weight (ppmw) of sulfur, wherein said sulfur-depleted effluent stream withdrawn from said reaction zone comprises less than about 50 ppmw of sulfur.

42. The process of claim 29, wherein the total sulfur mass flow rate of the sulfur-depleted effluent stream is less than about 10 percent of the total sulfur mass flow rate of the hydrocarbon feed stream.

43. The process of claim 29, wherein said hydrocarbon feed stream comprises gasoline.

44. The process of claim 29, wherein said hydrocarbon feed stream comprises diesel.

45. The process of claim 29, wherein said sorbent particles comprise a zinc oxide-containing support component and a nickel-containing promoter metal component.

46. The process of claim 29, wherein said sorbent particles have an average particle size in the range of from about 1 micron to about 500 microns.

* * * * *